United States Patent [19]

Theurer

[11] 4,165,694

[45] Aug. 28, 1979

[54] MOBILE TRACK LEVELING, LINING AND TAMPING APPARATUS

[75] Inventor: Josef Theurer, Vienna, Austria

[73] Assignee: Franz Plasser-Bahnbaumaschinen-Industriegesellschaft m.b.H., Vienna, Austria

[21] Appl. No.: 858,718

[22] Filed: Dec. 8, 1977

[30] Foreign Application Priority Data

Dec. 27, 1976 [AT] Austria ..... 9686/76

[51] Int. Cl.[2] ..... E01B 27/17; E01B 29/04

[52] U.S. Cl. ..... 104/7 B; 104/12

[58] Field of Search ..... 104/1 R, 2, 7 R, 7 A, 104/7 B, 8, 12; 37/104; 33/1 Q, 287; 172/126, 130, 131

[56] References Cited

U.S. PATENT DOCUMENTS

| | | | |
|---|---|---|---|
| Re. 27,604 | 3/1973 | Stewart et al. | 104/12 |
| 3,469,534 | 9/1969 | Plasser et al. | 104/12 X |
| 3,494,297 | 2/1970 | Plasser et al. | 104/7 B |
| 3,744,428 | 7/1973 | Plasser et al. | 104/7 R X |
| 3,750,299 | 8/1973 | Plasser et al. | 104/7 R X |
| 3,877,160 | 4/1975 | Plasser et al. | 37/104 |
| 4,031,625 | 6/1977 | Theurer | 104/8 X |
| 4,046,078 | 9/1977 | Theurer | 104/7 R |
| 4,046,079 | 9/1977 | Theurer | 104/12 X |

FOREIGN PATENT DOCUMENTS

| | | | |
|---|---|---|---|
| 1916281 | 10/1969 | Fed. Rep. of Germany | 104/12 |

*Primary Examiner*—Randolph A. Reese
*Attorney, Agent, or Firm*—Kurt Kelman

[57] ABSTRACT

A mobile track leveling, lining and tamping apparatus comprises a frame assembly mounted on undercarriages and mounting a tamping head, a track shifting unit and a reference system for controlling the track leveling and lining by the track shifting unit, and a drive for advancing the frame assembly in the working direction along the track. The frame assembly comprises a main frame and an auxiliary frame mounted on at least one of the undercarriages, one end of the main frame being adjacent one end of the auxiliary frame. A coupling is arranged between the ends of the main and auxiliary frames to permit at least temporary adjustment of the spacing between the frame ends and relative movement between the frames in the working direction. Track surfacing equipment is mounted on the auxiliary frame and the drive comprises a drive for the auxiliary frame. A control is operatively associated with the auxiliary frame drive for selectively driving the auxiliary frame with the main frame and relative to the main frame.

23 Claims, 5 Drawing Figures

MOBILE TRACK LEVELING, LINING AND TAMPING APPARATUS

The present invention relates to improvements in a mobile track leveling, lining and tamping apparatus comprising frame means mounted on undercarriages for mobility on the track in a working direction. In apparatus of this type, tamping means, track shifting means and a reference system for controlling the track leveling and lining by the track shifting means is mounted on the frame means, and the apparatus includes means for actuating the tamping and track shifting means, and means for driving the frame means in the working direction.

U.S. Pat. No. 3,469,534, dated Sept. 30, 1969, discloses such an apparatus wherein the frame means comprises a main frame mounting a tamping head and an auxiliary frame mounted on two undercarriages, one end of the main frame being adjacent one end of the auxiliary frame, and a pivotal coupling between the ends of the main and auxiliary frames. The track shifting means and surface tamping means are mounted on the auxiliary frame to enable the ballast tamped by the tamping head to be further compacted by the trailing surface tamping means so that the corrected track is securely held in position by the twice-tamped ballast. This machine has been very successful in practical operations but the track surfacing means on the auxiliary frame cannot operate continuously since the auxiliary frame is intermittently stopped with the main frame as the machine advances from tamping station to tamping station.

U.S. Pat. No. 4,046,078, dated Sept. 6, 1977, discloses another mobile track surfacing apparatus comprising a main frame and a trailing auxiliary frame. The main frame supports a first tamping head and the auxiliary frame supports a second tamping head, the adjacent ends of the frames being coupled for adjustment in the working direction.

The auxiliary frame is disclosed solely as a support for the additional tamping head and no other use is suggested therefor. While the spacing between the frames is adjustable, the two frames are advanced in unison along the track. The use of two successive tamping heads makes the control of the corrected track more difficult, particularly because the two frames execute different movements with respect to the track movements during correction.

In the track surfacing machine of U.S. Pat. No. 4,031,625, dated June 28, 1977, a forward car accommodating the work crew is coupled to the main frame of a generally conventional mobile track leveling, lining and tamping apparatus.

German Published Application (Offenlegungschrift) No. 1,916,281, published Oct. 23, 1969, discloses a mobile track surfacing machine wherein a trailing auxiliary frame is coupled to a machine main frame. The trailer supports rolls for compacting the ballast along the sides of the track and these compacting rolls can be repositioned on the trailing auxiliary frame in the working direction. This is an expensive structure because it requires an adjustable mounting for each surfacing tool and also a very sturdy construction of the auxiliary frame since it must be capable of supporting the compacting rolls along most of its length. No control for the surfaced track is provided.

It is the primary object of this invention to provide a mobile track leveling, lining and tamping apparatus of the indicated type wherein the surfacing operations can be controlled with greater accuracy to obtain a better track quality and wherein the individual surfacing operations may be effected independently of each other and without interfering with each other.

The above and other objects are accomplished in accordance with one aspect of the invention by arranging the coupling between the ends of the main and auxiliary frames to permit at least temporary adjustment of the spacing between the frame ends and relative movement between the frames in the working direction. Track surfacing means are mounted on the auxiliary frame and the means for driving the frame means of the apparatus in the working direction comprises a drive for the auxiliary frame. A control is operatively associated with the auxiliary frame drive for selectively driving the auxiliary frame with the main frame and relative to the main frame.

According to another aspect of the present invention, a track is surfaced by advancing the mobile apparatus intermittently along the track between successive tamping stations, the apparatus being stopped at each of the stations for tamping. The auxiliary frame is advanced non-stop at a substantially constant speed and advances in relation to the main frame while the main frame is stopped at the successive tamping stations and the main frame approaches the auxiliary frame as the main frame advances from station to station. The track surfacing means on the auxiliary frame continuously advances at the constant speed while the main frame of the apparatus advances intermittently.

In accordance with yet another aspect of this invention, a track is surfaced by advancing the mobile apparatus intermittently along the track between successive tamping stations, the apparatus being stopped at each of the stations for tamping. The track surfacing means mounted on the auxiliary frame comprises a centrally arranged ballast plow and associated lateral ballast plows for shaping and smoothing the ballast bed of the track, and the auxiliary frame is advanced independently of the main frame to move the ballast plows forwardly along the track, ballast being continuously moved laterally inwardly by the lateral ballast plows towards the tamping stations as the auxiliary frame advances.

A mobile track leveling, lining and tamping apparatus in accordance with the invention permits a modular construction by which the machine may be universally and selectively adapted to various operating conditions with respect to the arrangement of the track surfacing means and their selective operation, taking into account more particularly that some of these means are operated intermittently during track surfacing while other track surfacing means can be advantageously operated continuously. The machine frames may be coupled together to provide a compact machine since it is possible to couple the auxiliary frame to the main frame in the region of the driven undercarriage for the apparatus. The auxiliary frame may be relatively short and can be mounted on a single undercarriage, thus saving space and shortening the overall length of the apparatus while allowing sufficient space for the arrangement of the desired track surfacing means, the drive for the auxiliary frame permitting an exact positioning of the track surfacing means thereon. The coupling between the frames may be capable of sustaining and transmitting considerable pushing and tensile forces so that track surfacing means, such as ballast plows, which are subject to such forces of a high magnitude may be mounted on the auxiliary frame and may be operated continuously as the auxiliary frame advances non-stop, rather than being stopped intermittently with the main frame which is used for the track tamping and correcting operation. This substantially enhances the accuracy and the quality of the surfacing operation.

The modular construction has considerable economic advantages in permitting universally adaptable replacements of frames carrying different tools whereby varieties of mobile track leveling, lining and tamping machines may be produced in series since the main frame may remain substantially the same while the machine is adapted to different operating conditions and requirements by coupling differently equipped auxiliary frames thereto. Such auxiliary frames may, of course, also be coupled to existing track tampers.

The above and other objects, advantages and features of the present invention will become more apparent from the following detailed description of now preferred embodiments thereof, taken in conjunction with the accompanying schematic drawing wherein FIG. 1 is a side elevational view of a mobile track leveling, lining and tamping apparatus with frame means comprising a main frame, an auxiliary frame coupled to the main frame for continuous forward movement relative to the main frame, and another auxiliary frame coupled to the main frame at a fixed distance therefrom;

Figures 1, 2, 3, 4, 5:
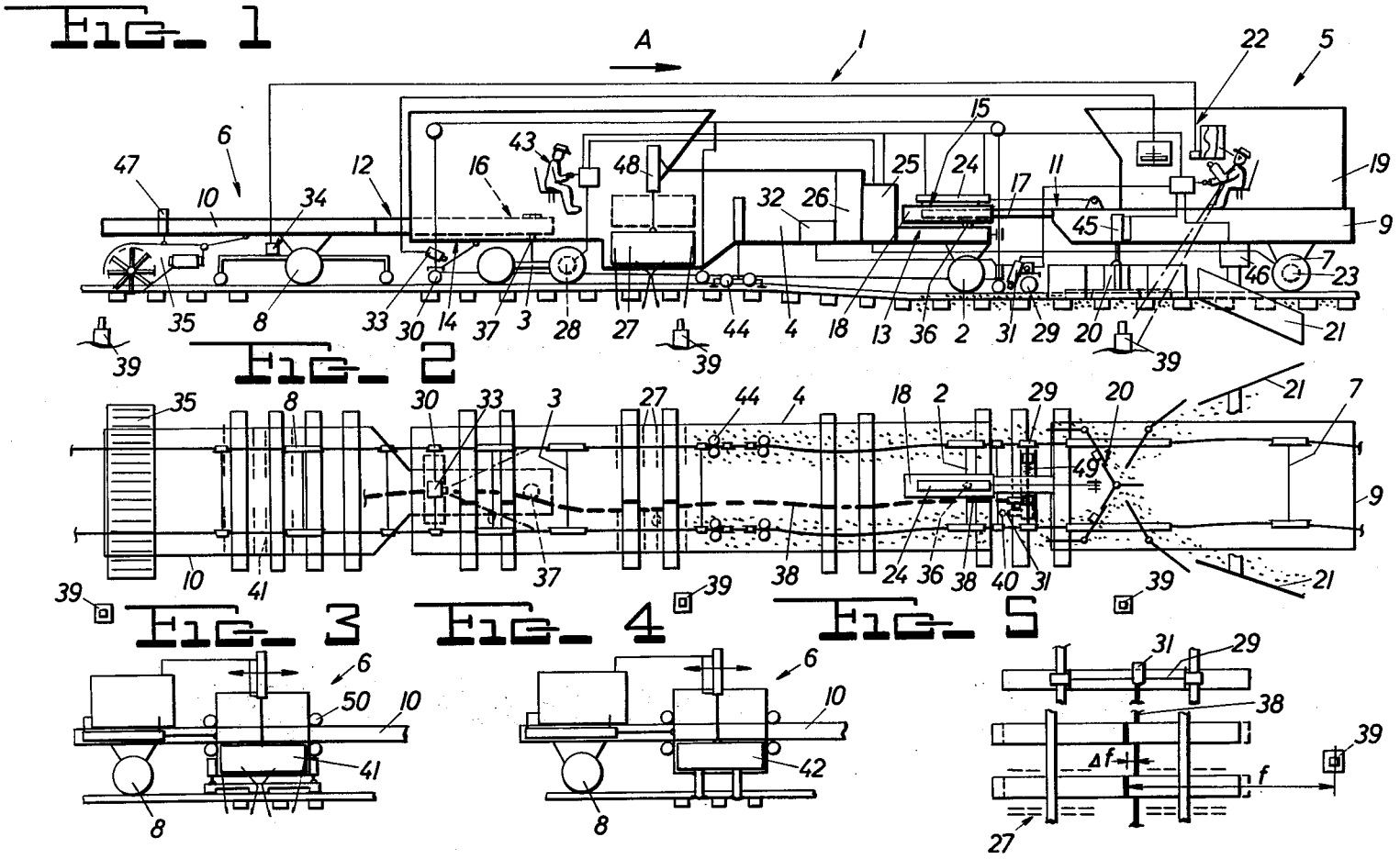
FIG. 2 is a top view of FIG. 1, also showing colored markers indicating the tamping stations and guiding the track lining, as well as the possibility of coupling a trailer according to FIG. 3 to the main frame.
FIG. 3 is a side elevational view of another type of trailer to be coupled to the main frame instead of the trailer of FIG. 1.
FIG. 4 is a like view of yet another type of trailer.
FIG. 5 is a top view, on an enlarged scale, of the portions of the track at a tamping station and a lining station.

Referring now to the drawing and first to FIG. 1, there is shown mobile track leveling, lining and tamping apparatus 1 comprising frame means mounted on undercarriages 2, 3, 7 and 8 for mobility on the track in a working direction indicated by arrow A. The frame means of the illustrated embodiment comprises main frame 4 mounted on front undercarriage 2 and rear undercarriage 3, front car 5 including auxiliary frame 9 mounted on undercarriage 7 and rear car 6 including auxiliary frame 10 mounted on undercarriage 8. A respective end 13, 14 of main frame 4 is adjacent a respective end 11, 12 of auxiliary frame 9, 10, respectively. Pivotal and detachable coupling 15 connects frame ends 11 and 13 while pivotal and detachable coupling 16 connects frame ends 12 and 14. Coupling 15 is arranged to permit at least temporary adjustment of the spacing between frame ends 11 and 13, and relative movement between frames 4 and 9 in the working direction indicated by arrow A. In the illustrated embodiment, coupling 15 comprises two telescopingly cooperating coupling parts 17, 18 respectively attached to auxiliary frame end 11 and main frame end 13. Each coupling is pivotally mounted on main frame 4 in the range of undercarriages 2 and 3, respectively, being connected, for example, to a king pin which mounts the undercarriages on the main frame so that the undercarriages constitute swivel trucks.

The provision of front and rear auxiliary frames, which are preferably pivotally coupled to the main frame, imparts added flexibility and adaptability to the apparatus since the selective use of various track surfacing means on the frames enables the track surfacing quality to be further enhanced. Telescoping couplings, particularly when hydraulically operated, provide very secure and dependable frame connections which are simple in construction and make accurate spacing adjustments between the frames possible.

The frame means 4, 9, 10 of apparatus 1 carries various track surfacing means, including tamping means 27, track shifting means 44 and means for shaping and smoothing the ballast bed of the track, illustrated as ballast plows 20 and 21. In the illustrated embodiment, centrally arranged ballast plow 20 is mounted on front auxiliary frame 9 and is vertically adjustable by hydraulic motor 45 which supports the plow on the frame. Associated lateral plows 21 are similarly mounted on frame 9 for vertical adjustment by means of hydraulic motor 46. The present invention is not concerned with the structure of the plow arrangement, the diagrammatically shown structure being more fully disclosed and claimed in U.S. Pat. No. 3,877,160, dated Apr. 15, 1975.

Operator's cab 19 is also mounted on auxiliary frame 9 and holds not only a chair for the operator but also control panel 22 from which the operator may survey and control the track position as well as the positioning of the ballast plows 20, 21. A drive for auxiliary frame 9, which permits at least temporary adjustment of the spacing between frame ends 11 and 13 and relative movement between frames 4 and 9 in the working direction, includes drive 23 operatively connected to the wheels of undercarriage 7 or hydraulic motor 24 enabling telescoping coupling parts 17, 18 to be moved relative to each other, or both. Control 25 is operatively associated with the auxiliary frame drive for selectively driving auxiliary frame 9 with main frame 4 and relative to the main frame in a manner to be described hereinafter, central power source 26 being connected to the control.

This arrangement enables the operator in cab 19 to keep the plows in view for optical surveying their operation, the control panel serving at the same time to control the reference system used in the track correction operation as well as the track shifting means used for the correction.

In the illustrated embodiment, the actuating and driving means are hydraulically operated and central power source 26 is a hydraulic fluid supply tank mounted on main frame 4. As is well known in apparatus of this type, the hydraulic fluid supply tank is connected to the various hydraulic motors actuating the track surfacing means and driving the machine frame means by a hydraulic circuit and the flow of hydraulic fluid to the motors is controlled by control 25, also mounted on main frame 4, in a well known manner. The track surfacing means controlled in this manner include track shifting means 44, which is a combined track lifting and lining unit of any known type, and vertically adjustable tamping head 27. Another operator's cab 43 is mounted on main frame 4 from which an operator may control not only the operation of tamping means 27, which is within visible range of cab 43, but also drive 28 operatively connected to the wheels of rear undercarriage 3 of the main frame. Thus, auxiliary frame 9 is self-propelled by drive 23 while drive 28 provides independent forward movement for main frame 4.

The apparatus further comprises a reference for the leveling of the track, which is vertically movable with respect to main frame 4, and a reference for the lining of the track is also associated with the main frame. In a manner well known per se, the lining reference includes a wire tensioned between measuring bogies 29, 30 which are pressed against the reference rail used for the lining operation. Dye spraying means 31 is affixed to forward measuring bogie 29 and its operation is controlled from panel 22 in cab 19, a dye holding tank 32 being connected to spraying means 31 for selectively supplying dye thereto under the control of the operator in cab 19. Colored marks 40 on the track ties and ballast applied by spraying means 31 in the direction of track elongation indicate lining deviations of the track with respect to fixed reference points 39 provided at spaced points along the track. Television observation means constituted by television camera 33 is mounted on rear measuring bogie 30 for observing the colored marks in the operation of track shifting means 44 for lining the track. Since the dye spraying means and the television camera are affixed to the front and rear measuring bogies, respectively, they are held without play against the reference rail whereagainst the bogies are pressed. The dye spraying means may be arranged for continuously applying the colored mark as a marking line extending in the direction of track elongation. The television camera has intersecting hairlines and is fixed with respect to the median axis of the track to enable the colored mark to be viewed on a television screen on panel 22 so that the operator in cab 19 may observe the track position.

This arrangement makes it possible to observe the lateral deviations of the track from a desired alignment, which may be represented by fixed reference points, without constant manual measurements, thus dispensing with an additional operator outside of the machine, the operator in cab 19 being able to observe and control the marking directly while also having control over the alignment of the track by means of the television camera mounted in the corrected track section. The amount of the required lining stroke, for instance for the adjustment and guidance of the forward end point of the reference, is thus indicated to the operator in cab 19 while the operator in cab 43, who works the tamping tools, can optically observe the result of the lining operation. Furthermore, the use of the television camera makes it possible to control over an extended track section the result of the lining operation and the trend of the track alignment on the basis of the lateral movement of the marks on the ties.

Making the auxiliary frame 9 self-propelled and providing an independent drive for main frame 4 makes it possible to use a central power source mounted on the main frame for both independent drives while the one drive advances the main frame intermittently between tamping stations and the other drive advances the auxiliary drive non-stop. The speed of drive 23 may be preset to impart to the auxiliary frame a constant speed forward movement somewhat slower than the speed of drive 28.

If the control for the non-stop advance of auxiliary frame 9 is preset to a constant speed to move the auxiliary frame forward at this speed in the working direction relative to the main frame while the latter is stopped at a tamping station and to move the main frame intermittently forward in this direction towards the auxiliary frame between successive tamping stations, during which relative movements the telescoping coupling parts of coupling 15 move relatively to each other, the entire machine is compact while its modular frame components with their respective working equipments are operated to best advantage. This arrangement reduces the driving power requirements, particularly for the ballast plow system, as well as a proper flow of the ballast for a favourable track support while the plows are subjected to a minimum of wear. Furthermore, the accuracy of the track position survey and control is increased since the brief accelerations and decelerations encountered in the intermittent advances of the main frame are avoided with the non-stop movement of the auxiliary frame carrying the control cab. A hydraulically operated telescoping coupling is particularly simple in construction and dependable in use. Mounting the track position survey and control panel on forward auxiliary frame 9 for controlling the track survey and correction equipment on the main frame or the rear auxiliary frame has the advantage that the survey of the corrected track can be accurately and centrally recorded, and the operator may use the survey parameter for controlling the ballast plows, for instance to move more ballast into the region of the tie ends to hold the track in lateral alignment, if the measurements show this to be desirable or required.

As shown in the embodiment of FIG. 1, the frame means of apparatus 1 also comprises another auxiliary frame 10 mounted on undercarriage 8 and having one end 12 adjacent end 14 of main frame 4 opposite to its end 13. A track position survey apparatus 34 having wheels running on the track rails is mounted on undercarriage 8 for surveying such track parameters as grade, alignment, camber, track gage and the like for correcting the track. The invention is not concerned with the particular structure of such track survey apparatus and any wheeled survey bogie may be used, such as disclosed, for example, in U.S. Pat. No. 3,557,459, dated Jan. 26, 1971, U.S. Pat. No. 3,751,815, dated Aug. 14, 1973, U.S. Pat. No. 3,769,715, dated Nov. 6, 1973, or U.S. Pat. No. 3,816,927, dated June 18, 1974. Rear auxiliary frame 10 also supports ballast shaping broom 35 which is vertically adjustable with respect to the frame by hydraulic motor 47. The hydraulic motors 45, 46 and 47 for vertically adjusting the ballast plows and broom, as well as hydraulic motor 48 for vertically adjusting tamping head 27 are all connected to central hydraulic fluid tank 26.

Coupling part 18 of coupling 15 is mounted on kingpin 36 on main frame 4 in the range of the front undercarriage while coupling 16 is kingpin 37 of the rear undercarriage, both auxiliary frames being coupled to the main frame ends by a universal joint.

The top view of FIG. 2 shows the positioning of the plow blades of central plow 20 and of lateral plows 21 during the non-stop forward movement of auxiliary frame 9 so as to move the ballast inwardly towards the track support regions where the rails intersect the ties.

Dye spraying nozzle 31 is mounted on a threaded spindle extending in a direction parallel to the track ties and may be adjustably positioned transversely to the track by rotating the spindle by means of a motor. Colored marks 38 serve to indicate the required lining stroke, i.e. the deviation of the uncorrected track from fixed points 39 mounted along the track to indicate the desired track alignment. Additional colored marks 40 on the ballast in selected cribs indicate to the operator where to immerse the tamping tools at the end of each intermittent forward movement of main frame 4. These operational controls by colored marks are known in the track surfacing art and do not form part of the present invention, except as far as combined with the modular construction of the machine.

In the embodiment of FIG. 3, rear auxiliary frame 10 carries additional tamping means 41 constituted by a tamping head capable of simultaneously tamping two successive ties and including a device for holding down the track section being held at a desired grade. An apparatus of the type diagrammatically shown in FIG. 3 has been disclosed and claimed in application Ser. No. 695,643, now U.S. Pat. No. 4,068,596. Tamping head 41 is mounted on rollers 50 for movement on frame 10 in the working direction so that it may be repositioned in accordance with the tie spacing encountered along the track. Tamping heads 27 and 41 together form an apparatus for simultaneously tamping four ties at every tamping station, i.e. when main frame 4 with its attached auxiliary frame 10 stops. FIG. 2 indicates schematically the position of the tamping tools of tamping heads 27 and 41. This modification enables the apparatus to be adapted rapidly to different types of track, i.e. for use of the machine in rapid succession on main and branch tracks, the utilization of additional tamping head 41 enabling the apparatus to achieve high tamping efficiency on main tracks whose surface conditions are usually fairly good while the same machine can be used in less frequency maintained branch tracks whose surface conditions are correspondingly worse and which, therefore, require rather thorough leveling, lining and tamping, as well as ballast profiling, in a single pass of the machine.

The modification of FIG. 4 differs from the embodiment of FIG. 3 only by the nature of the tamping tools used on tamping head 42. In this modification, the tamping head carries tamping tools for compacting the surface of successive cribs. In either modification, ballast broom 35 may be mounted rearwardly of undercarriage 8 on frame 10, in addition to the tamping head which is mounted forwardly of the undercarriage.

The above-described mobile track leveling, lining and tamping apparatus may be operated in the following manner to surface a track:

While the frame means mounted for mobility on the track on undercarriages is advanced intermittently along the track between successive tamping stations, where the track may be lifted and corrected while the apparatus is stopped for tamping, auxiliary front frame 9 is advanced non-stop in relation to main frame 4 which is stopped at the successive tamping stations, together with rear auxiliary frame 10 which is stationary with respect to the main frame, i.e. at a constant spacing therefrom. At the tamping stations, all required track surfacing work is done with equipment mounted on frames 4 and 10, i.e. track shifting means 44 is operated to level and/or line the track and tamping head 27, as well as tamping head 41 or 42, if desired, is operated to compact the ballast under the ties and thus fix the corrected track in position. Meanwhile, control 25 maintains a pre-set speed to keep front auxiliary frame 9 in foward motion by operating drive 23 and/or 24. The forward speed of the auxiliary frame is set in accordance with a given tamping cycle, i.e. the time interval between the stoppage of the main frame at two successive tamping stations. While the track surfacing work at the tamping station proceeds, front car 5 moves away from main frame 4 and, after the surfacing work has been completed, main frame 4 is advanced at a speed in excess of that of front car 5, whose speed remains constant. If drive 28 moves the main frame and drive 23 moves the auxiliary frame, the relative speeds will cause the telescoping coupling parts 17 and 18 to move relative to each other and the main frame to be moved towards the auxiliary frame. If drive 24 is used additionally or instead of drive 23 to move the auxiliary frame, control 25 will actuate drive 24 so that the adjustable coupling will pull the main frame towards the auxiliary frame at such a speed that the residual relative speed between the forward movement of main frame 4 and the movement of front car 5 corresponds to the desired constant speed non-stop movement of car 5. If desired and found useful under the given operating conditions, rear auxiliary frame 10 may be similarly coupled to the main frame for relative movement with respect thereto or only the rear frame may be so arranged.

During the continuing operation of the apparatus, various track surfacing tools may be placed and/or utilized on rear car 6, such as shown in FIGS. 3 and 4, so that the entire apparatus may be rapidly adapted to a variety of track conditions, thus increasing the universal usefulness of the machine for a number of different operations, including track surfacing of newly laid track, main track tamping, branch track tamping and others.

In this manner, centering of the tamping tools over successive cribs and ties is facilitated by the intermittent stoppage of the frame or frames on which such track surfacing tools are mounted while this portion of the apparatus is coupled to, and coordinated with, other portions which sould be moved forwardly continuously, such as ballast plow arrangements or track survey equipment. With one compact machine of modular construction, a track surfacing method adapted to various track conditions may thus be accomplished.

Also, where a centrally arranged ballast plow and associated lateral ballast plows for shaping and smoothing the ballast bed of the track are mounted on the auxiliary frame which is advanced non-stop independently of the main frame, the continuously forwardly moving lateral ballast plows will continuously move ballast laterally inwardly towards the tamping stations as the auxiliary frame advances. At the same time, the central plow will suitably shape the ballast bed on which the track rests, all of these ballasting operations proceeding while successive track sections are leveled, lined and tamped, as may be required. Suitable positioning of the ballast plows will enable proper shaping of the ballast bed and movement of additional ballast into the regions where the rails intersect the ties and which require more ballast for the subsequent tamping operation. This considerably improves the quality of the track surfacing since it is always possible to bring the desired amounts of ballast to the tamping stations as the apparatus advances along the track. This will provide very dense ballast supports for the track and correspondingly enhances the quality and accuracy of the track correction. To achieve such superior results with a single machine in a single pass has heretofore not been possible.

Independent of the central power source 26 on main frame 4, it may be desirable to provide an independently operating drive for each of the frames of the apparatus so that the frames may be readily interchanged for adaptation to various track surfacing conditions and requirements, thus providing a machine built on the modular principle. Also, while the front auxiliary frame has been described and illustrated as movable in relation to the main frame while the rear auxiliary frame is stationary with respect thereto, this may be reversed. Furthermore, particularly where large amounts of ballast are to be handled, such as in surfacing new track, the rear auxiliary frame may carry an additional central plow to enable any residual ballast in the track area to be suitably shaped and moved off the ties.

The couplings used to connect the frames may structurally vary greatly. For instance, couplings of the type used to connect trailers to tractors in tractor-trailer trucks may be used. Various mechanisms may be provided for adjusting the length of the coupling and drive 24 may be a nut-and-spindle drive, a rack-and-pinion drive or any other suitable drive mechanism. A multistep hydraulic motor is preferred since it may be readily integrated in a telescoping coupling.

FIG. 5 shows a track section in the region of the tamping station where tamping head 27 operates, the repositioning of colored mark 38 being shown after the ties have been transversely shifted from the position shown in broken lines to that shown in full lines. The lining stroke is indicated by $\Delta f$, the distance of the colored mark from fixed reference point 39 being f. The colored line mark 38 is produced by the dye spray device 31 mounted on bogie 29 in a manner described hereinabove. This device is held against play with respect to the right rail which is the reference rail and produces a substantially continuous marking line as auxiliary frame 9 advances non-stop along the track. After the track has been laterally shifted in a lining operation, the portions of the marking line on the ties will be accordingly shifted in relation to the portions of the marking line on the ballast, as illustrated, so that the operator in cab 19 may visually observe the extent of the lateral shifting on his TV-screen, thus noting the trend in the lining of the track. If this observation indicates the need for a correction of this trend, he can suitably control the amount of lining, thus gaining a constant quality control to enable him to correct the lining operation.

If the dye spray nozzle is mounted on a transverse spindle drive 49, a colored mark of a length indicating the length of the required lining stroke may be applied by the nozzle. The beginning of the colored mark may be at the track center and the mark may be applied to a tie and the ballast of the adjacent crib in a direction extending from the track center towards the direction of lining. The track is then shifted by the amount indicated by the length of the mark. It is also possible to shift the end point of the reference according to this mark.

If desired, the TV-screen on which the colored marking is observed may be mounted in rear cab 43 instead of front cab 19.

What is claimed is:

1. A mobile track leveling, lining and tamping apparatus comprising frame means mounted on undercarriages for mobility on the track in a working direction, tamping means, track shifting means and a reference system for controlling the track leveling and lining by the track shifting means mounted on the frame means, means for actuating the tamping and track shifting means, and means for driving the frame means in the working direction, the frame means comprising a main frame and an auxiliary frame mounted on at least one of the undercarriages, one end of the main frame being adjacent one end of the auxiliary frame, a coupling between the ends of the main and auxiliary frames, the coupling being arranged to permit at least temporary adjustment of the spacing between the frame ends and relative movement between the frames in the working direction, track surfacing means mounted on the auxiliary frame, the driving means comprising a drive for the auxiliary frame, and a control operatively associated with the auxiliary frame drive for selectively driving the auxiliary frame with the main frame and relative to the main frame, the control being arranged to control the auxiliary frame drive for non-stop forward movement of the auxiliary frame in the working direction at a pre-adjustable constant speed, whereby the auxiliary frame moves away from the main frame at said speed when the main frame is stopped during successive, intermittent track leveling, lining and tamping cycles, and the speed is pre-adjusted to one lower than that of the main frame in movement whereby the main frame approaches the auxiliary frame during said movement.

2. The mobile track leveling, lining and tamping apparatus of claim 1, wherein the track surfacing means comprises means for shaping and smoothing the ballast bed of the track.

3. The mobile track leveling, lining and tamping apparatus of claim 1, further comprising a power source connected to the control, the control operating the actuating and driving means.

4. The mobile track leveling, lining and tamping apparatus of claim 1, wherein the coupling pivotally connects the main and auxiliary frame ends.

5. The mobile track leveling, lining and tamping apparatus of claim 1, wherein the frame means further comprises another auxiliary frame mounted on at least one of the undercarriages and having one end adjacent an end of the main frame opposite to the one end thereof, and a coupling between the one end of the other auxiliary frame and the opposite main frame end.

6. The mobile track leveling, lining and tamping apparatus of claim 5, wherein the coupling pivotally connects the one end of the other auxiliary frame and the opposite main frame end.

7. The mobile track leveling, lining and tamping apparatus of claim 5, further comprising additional tamping means and a ballast broom rearwardly of the additional tamping means in the working direction mounted on the other auxiliary frame.

8. The mobile track leveling, lining and tamping apparatus of claim 1, the one main frame end being the forward end in the working direction, and the track surfacing means comprising a centrally arranged ballast plow and associated lateral ballast plows for shaping and smoothing the ballast bed of the track.

9. The mobile track leveling, lining and tamping apparatus of claim 1, wherein the coupling comprises two telescopingly cooperating coupling parts respectively attached to the main and auxiliary frame ends.

10. The mobile track leveling, lining and tamping apparatus of claim 1, the one main frame end being the forward end in the working direction, further comprising an operating cab mounted on the auxiliary frame and a track survey control in the cab.

11. The mobile track leveling, lining and tamping apparatus of claim 10, further comprising track survey means mounted on a part of the frame means other than the auxiliary frame, the track survey means being associated with the track survey control.

12. The mobile track leveling, lining and tamping apparatus of claim 11, wherein the other part of the frame means is another auxiliary frame mounted on at least one of the undercarriages and having one end adjacent an end of the main frame opposite to the one end thereof, the other auxiliary frame being coupled to the opposite main frame end.

13. The mobile track leveling, lining and tamping apparatus of claim 1, the one main frame end being the forward end in the working direction, the track surfacing means comprising a centrally arranged ballast plow and associated lateral ballast plows for shaping and smoothing the ballast bed of the track, one of said undercarriages being a front undercarriage for the main frame, the ballast plows being arranged between the front undercarriage and the undercarriage whereon the auxiliary frame is mounted, the frame means further comprising another auxiliary frame mounted on one of the undercarriages and having one end adjacent an end of the main frame opposite to the one end thereof, a coupling between the one end of the other auxiliary frame and the opposite main frame end, and a ballast broom on the other auxiliary frame arranged behind the undercarriage thereof in the working direction.

14. The mobile, track leveling, lining and tamping apparatus of claim 1, further comprising dye spraying means mounted in a forward section of the frame means for applying a colored mark on the track ties and ballast in the direction of track elongation for indicating lining deviations of the track, and a television observation means mounted in a rear section of the frame means for observing the colored mark in the operation of the track shifting means for lining the track.

15. The mobile track leveling, lining and tamping apparatus of claim 14, further comprising means for holding the dye spraying means and the television observation means without play against a reference rail of the track.

16. The mobile track leveling, lining and tamping apparatus of claim 1, wherein the coupling comprises two telescopically cooperating coupling parts respectively attached to the main and auxiliary frame ends and means for hydraulically adjusting the relative spacing between the coupling parts.

17. A mobile track leveling, lining and tamping apparatus comprising frame means mounted on undercarriages for mobility on the track in a working direction, tamping means, track shifting means and a reference system for controlling the track leveling and lining by the track shifting means mounted on the frame means, means for actuating the tamping and track shifting means, and means for driving the frame means in the working direction, the frame means comprising a main frame and an auxiliary frame mounted on at least one of the undercarriages, one end of the main frame being adjacent one end of the auxiliary frame, a coupling between the ends of the main and auxiliary frame, the coupling being arranged to permit at least temporary adjustment of the spacing between the frame ends and relative movement between the frames in the working direction, track surfacing means mounted on the auxiliary frame, the driving means comprising a drive for the auxiliary frame, a control operatively associated with the auxiliary frame drive for selectively driving the auxiliary frame with the main frame and relative to the main frame, dye spraying means mounted in a forward section of the frame means for applying a colored mark on the track ties and ballast in the direction of track elongation for indicating lining deviations of the track, the dye spraying means being arranged for continuously applying the colored mark as a marking line extending in the direction of track elongation, and a television observation means mounted in a rear section of the frame means for observing the colored marking line in the operation of the track shifting means for lining the track.

18. A track surfacing method wherein a mobile track leveling, lining and tamping apparatus comprising frame means mounted on undercarriages for mobility on the track is advanced intermittently along a track between successive tamping stations, the apparatus being stopped at each of the stations for tamping, the frame means comprising a main frame and an auxiliary frame mounted on at least one of the undercarriages, one end of the main frame being adjacent one end of the auxiliary frame, and track surfacing means being mounted on the auxiliary frame, which comprises the step of advancing the auxiliary frame non-stop at a substantially constant speed, the auxiliarly frame advancing in relation to the main frame while the main frame is stopped at the successive tamping stations and the main frame approaching the auxiliary frame as the main frame advances from station to station, the track surfacing means on the auxiliary frame continuously advancing at the constant speed while the main frame of the apparatus advances intermittently.

19. The track surfacing method of claim 18, wherein the track is lifted and corrected at each one of the tamping stations, the main frame mounting track tamping and shifting means for effectuating the track correction and tamping.

20. The track surfacing method of claim 18, wherein the constant speed of the auxiliary frame is set lower than the speed of the intermittent advance of the main frame whereby the main frame approaches the auxiliary frame as the main frame advances from station to station.

21. A track surfacing method wherein a mobile track leveling, lining and tamping apparatus comprising frame means mounted on undercarriages for mobility on the track is advanced intermittently along a track between successive tamping stations, the apparatus being stopped at each of the stations for tamping, the frame means comprising a main frame and an auxiliary frame mounted on at least one of the undercarriages, one end of the main frame being adjacent one end of the auxiliary frame, and track surfacing means comprising a centrally arranged ballast plow and associated lateral ballast plows for shaping and smoothing the ballast bed of the track mounted on the auxiliary frame, which comprises the step of advancing the auxiliary frame continuously and independently of the main frame to move the ballast plows forwardly along the track, ballast being continuously moved laterally inwardly by the lateral ballast plows towards the tamping stations as the auxiliary frame advances.

22. The track surfacing method of claim 21, wherein the track is lifted and corrected at each one of the tamping stations, the main frame mounting track tamping and shifting means for effectuating the track correction and tamping.

23. The track surfacing method of claim 21, wherein the auxiliary frame is adjacent a forward end of the main frame in the working direction of the apparatus.

* * * * *